United States Patent [19]

Dismukes

[11] Patent Number: 4,627,502

[45] Date of Patent: Dec. 9, 1986

[54] LIQUID-FILLED COLLAR FOR TOOL STRING

[76] Inventor: Newton B. Dismukes, 2952 Buttonwood Dr., Carrollton, Tex. 75006

[21] Appl. No.: 756,785

[22] Filed: Jul. 18, 1985

[51] Int. Cl.[4] ..... E21B 17/16

[52] U.S. Cl. ..... 175/320; 175/61; 166/242

[58] Field of Search ..... 175/61, 65, 73, 318, 175/320; 166/242, 284, 350, 359

[56] References Cited

U.S. PATENT DOCUMENTS

| | | | |
|---|---|---|---|
| 2,814,462 | 11/1957 | De Jarnett | 175/320 |
| 3,179,188 | 4/1965 | De Jarnett | 175/320 |
| 3,265,091 | 8/1966 | De Jarnett | 166/242 |

*Primary Examiner*—Stephen J. Novosad

*Assistant Examiner*—Terry Lee Melius

*Attorney, Agent, or Firm*—Drude Faulconer

[57] ABSTRACT

A liquid-filled collar for applying weight to the nether end of a tool string which is to be used in a wellbore filled with wellbore liquid. The collar has an annulus formed between inner and outer conduits which annulus is at least partially filled with a dense liquid having a density greater than that of the wellbore liquid. The annulus is open at the top to the wellbore liquid so that the head of the wellbore liquid acts on the head of the dense liquid in the annulus to exert a force on the bottom closure of the annulus to produce a downward force greater than the upward buoyant force of the wellbore liquid. Low density liquid having a density less than the wellbore liquid can fill a portion of the annulus below the dense liquid to provide buoyancy for the collar when used in horizontal wellbores.

26 Claims, 7 Drawing Figures

20a
32
37b
43
21
31
41
40
36
39
25
37c 36
39
41
37a
40
10
7
7
50
33
35
45
14a 31
32
50

LIQUID-FILLED COLLAR FOR TOOL STRING

DESCRIPTION

1. Technical Field

The present invention relates to a method and apparatus for applying force (i.e. weight) to the nether end of a tool string for advancing the tool string in a wellbore and more particularly relates to a tool string collar, e.g. drill collar, having a high density liquid therein which is capable of applying substantial weight to the nether end of a tool string while maintaining substantially the entire tool string tubulars in tension.

2. Background Art

Various tool strings are routinely used in drilling and completing hydrocarbon-producing wells or the like. That is, a drill string is used for drilling the well; a casing string is run into the wellbore and cemented therein to complete the well; and other strings are used to carry out various other operations in the wellbore, e.g. logging operations, fishing operations, perforating operations, etc. In each such operation, the particular tool string or shaft has to be weighted so as to overcome the buoyant and frictional drag force normally experienced as it is advanced in the well-bore. In drilling, this is routinely done by using heavy-walled or "hevi-wate" pipe called "collars" to make up the nether end of the tool string.

While such steel collars are widely used to apply weight to the nether end of a tool string, there are problems inherent in their use. In drilling, for example, heavy drill collars are coupled into the drill string just above the bit. As the drill string advances in the wellbore, the liquid, i.e. drilling mud, therein exerts an increasing upward buoyant force against the bottom of the drill string. The "neutral point" in the drill string (i.e. that point below which the string is in compression and above which it is in tension) begins to move upward in the drill string as the increasing buoyant force puts more and more of the nether end of the drill string in compression. When the bit reaches the bottom of the wellbore, continued lowering of the drill string puts most, if not all, of the collars in compression, often severe, as the weight of the collars is applied on the bit for drilling. The resulting high bending moments often cause buckling failures in the drill strings as understood in the art.

The problems involved in providing proper weight at the nether end of a tool string are further complicated in the drilling and completing of deviated, lateral, or horizontal wells, sometimes called "extended reach drilling". Typically in such operations, the wellbore is first drilled in a substantially vertical direction and is then deviated to extend substantially horizontally into a producing formation. Currently, brute force approaches are used to force the tool string into and through the curved and horizontal sections of the wellbore.

For example, heavy drill collars are coupled into a drill string at a substantial distance above the bit so that the collars will be in the vertical section of the wellbore during drilling. The weight of the collars in the vertical wellbore is applied downward through the pipe therebelow to provide the weight on bit in the horizontal wellbore. This raises the neutral point to a substantial distance above the nether end of the drill string thereby putting a substantial portion of the string in compression. In addition to the obvious potential buckling failures due to the length of drill string in compression, the frictional drag of the pipe against the horizontal wellbore and the force required to bend the stiff pipe through the curved and dog-leg portions of the wellbore seriously reduces the advancing force, i.e. weight-on-bit, available at the bit. This also is true when a downhole rotary motor is used to rotate the bit. Reduced penetration rates, high equipment costs, and frequent hole problems often combine to make the present costs of drilling and completing horizontal wells prohibitively high.

DISCLOSURE OF THE INVENTION

The present invention provides a method and apparatus for providing an advancing force (i.e. weight) to the nether end of a tool string while maintaining the neutral point at or below the nether end of the tool string. That is, the present invention provides substantial weight to the nether end of a tool string without putting any substantial portion of the string in compression. This effectively allows the entire tool string to remain in tension which all but eliminates potential buckling problems in the drill string. Also, the present invention is particularly adaptable for use in drilling directional or horizontal wells in that the advancing force for the tool string in the horizontal portion is applied through a liquid column instead of the tool string, itself. Hydrostatic pressure causes the entire string to remain in tension.

More specifically, the present invention provides a tool string collar, e.g. drill collar, adapted to be connected to a tool string which in turn, is to be used in a wellbore filled with a wellbore liquid, e.g. drilling mud. The collar is comprised of generally concentric inner and outer conduits which form an annulus therebetween which extends longitudinally through the collar. The annulus is closed at the bottom by a thick, heavy closure plate that is welded or otherwise secured between the conduits. The closure plate has a connector means therethrough to which the nether end of the inner conduit is releasably connected. An upper plate is releasably connected between the upper ends of the conduits over the annulus and has openings therein for fluid communication between the annulus and the wellbore liquid.

At least a portion of the annulus is filled with a predetermined volume of a dense liquid having a density (e.g. 24 pounds or greater per gallon) greater than that of the wellbore liquid. The hydrostatic head provided by this volume of dense liquid when combined with the head of the supernatant wellbore liquid applied thereto through the upper plate produce a downwardly acting force on the topside of the bottom closure plate which is substantially greater than the upward acting buoyant forces acting on the nether end of the tool string. The difference between these forces is equal to the amount of weight that is available as weight-on-bit during drilling operations. This force is applied through the liquid column or continuum in the collar annulus as opposed to compression in the walls of the tool string itself.

In an embodiment of the present invention, a portion of the annulus below that filled with dense liquid is filled with a low density liquid (e.g. water or oil ) which has a density less than that of the wellbore liquid and the collar is designed so that the portion filled with the low density liquid will lie in the horizontal portion of a wellbore during drilling and the dense liquid portion will be in the vertical section. The low density liquid provides a buoyant force for the collar in the wellbore liquid and aids in reducing frictional drag of the collar against the lowside of the horizontal wellbore. The head of the dense liquid still acts downward to produce a force which is transmitted undiminished to the closure plate through the liquid continuum in the annulus.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
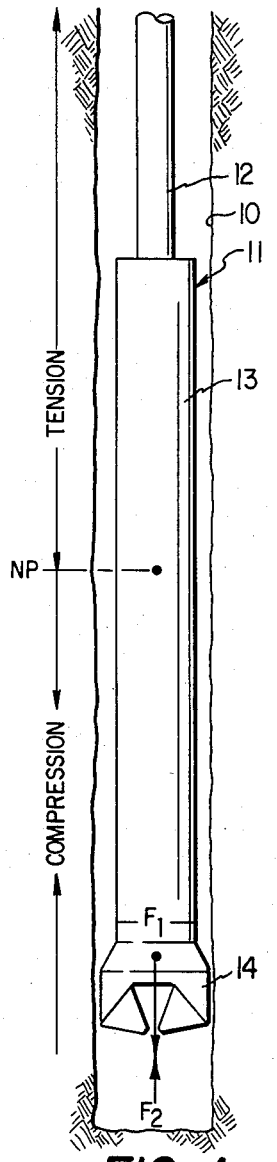
FIG. 1 (PRIOR ART)
FIG. 1 is an idealized representations of certain force applied to a prior art tool string.

Referring now to the drawings, FIG. 1 illustrates the forces normally involved as a prior art drill sring 11 is lowered into wellbore 10 which is filled with liquid, e.g. drilling mud. Drill stirng 11 is comprised of a string of drill pipe 12 having one or more heavy-walled drill collars 13 on the nether end thereon to which drill bit 14 is affixed. As understood in the art, collars 13 are used to strengthen the drill string at its nether end and to provide weight on bit 14 during drilling. Drill string 11 is suspended from the surface (not shown) and is lowered under its own weight into wellbore 10. Immediately as drill string 11 enters wellbore 10, the buoyancy force $F_2$ (which equals the fluid pressure in pound per square inch multiplied by net effective cross sectional area of the drill collars 13 in square inches) begins to act upwardly to oppose the downward force $F_1$ (weight of suspended drill string 11). The application of force $F_2$ causes the lowermost portion of the nether end of drill string 11 to undergo compression while the remainder of drill string 11 thereabove remains in tension due to the fact that it is being suspended in the wellbore from its upper end (i.e., its weight exceeds the weight of the fluid it displaces).

As the lowering of drill string 11 continues, force $F_2$ continues to increase due to the increasing pressure of the wellbore liquid being displaced. This, in turn, continues to put a greater and greater portion of the drill string 11 in compression. That is, the neutral point (tension/compression) NP continues to moves upward in the drill string as the string is lowered into the wellbore. "Tension/compression neutral point" being defined herein as that imaginary plane normal to axis of a vertical drill string below which the drill string is in compression and above which the drill string is in tension.

It is routine drilling practice to design a drill string so that when the bit is on bottom and the necessary weight applied thereto, the neutral point NP will always lie in the drill collars 13 with all of the pipe 12 thereabove being in tension. However, this technique still requires a substantial length of drill string 11 to be in compression, often severe, during drilling which can result in high bending moments which, in turn, may cause buckling failures in the drill string.

Figure 3:
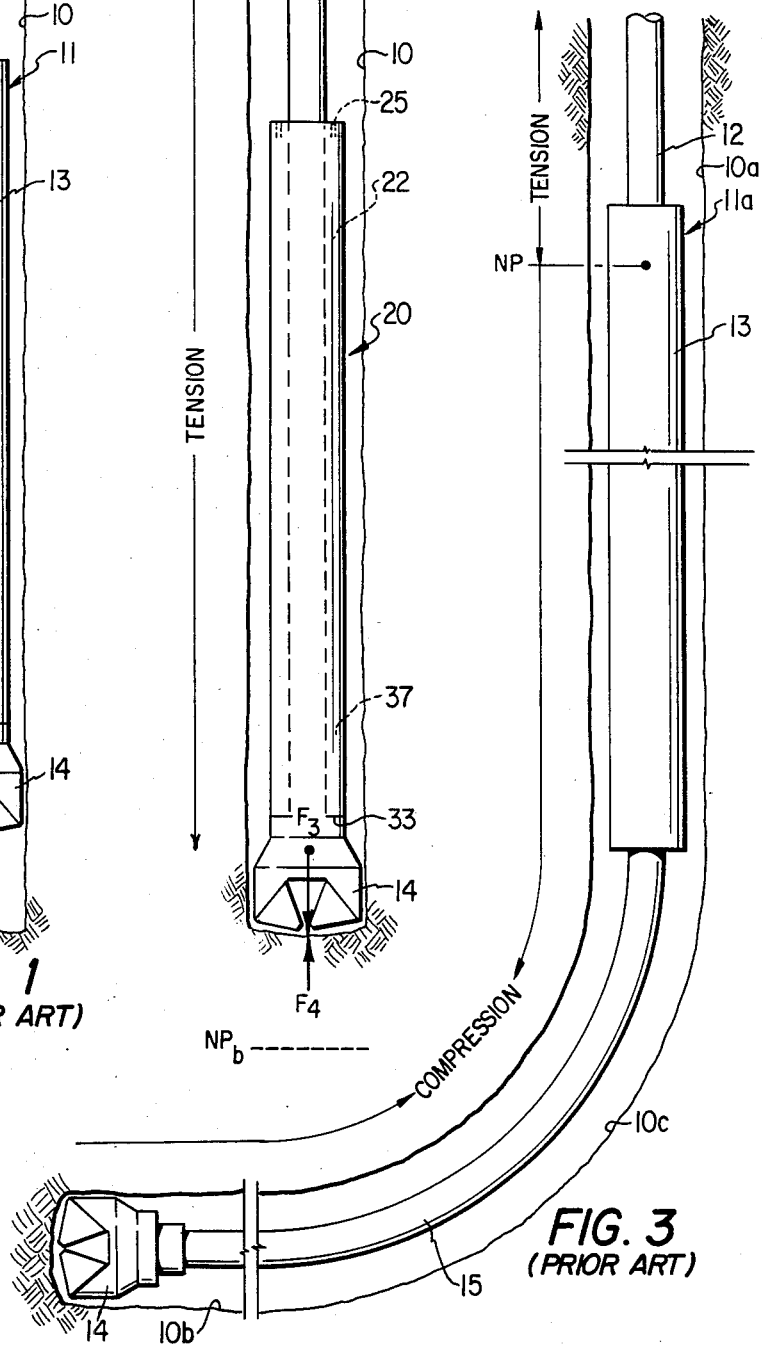
FIG. 3 (PRIOR ART)
FIG. 3 is an idealized representation of certain forces applied to a prior art tool string used in horizontal wellbores.

This problem is amplified in directional drilling operations (FIG. 3) wherein wellbore 10 is first drilled in a substantially vertical direction and then deviated to a horizontal direction. A typical drill string 11a used in such operations is designed so that drill collars 13 lie in vertical portion 10*a* of the wellbore during drilling so that the weight of collars 13 is applied downward through curved drill pipe 15 to bit 14. This obviously raises the neutral point NP well above the nether end of the drill string thereby putting a substantial length of the drill string therebelow in compression. Also, due to the friction of pipe against the walls of the wellbore and the force required to bend the pipe through curved section 10*c* of the wellbore, the weight available to advance the drill bit 14 is seriously reduced, sometimes to the point of being inadequate for this purpose.

Figure 2:
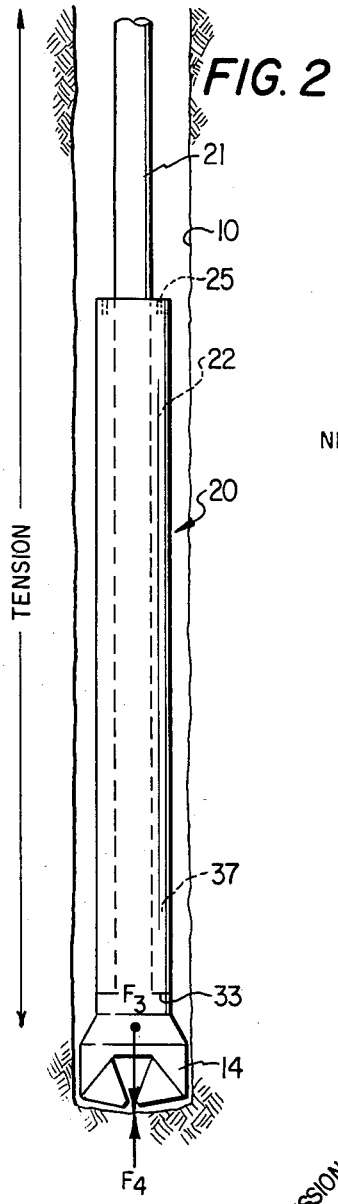
FIG. 2 is an idealized representation of the same forces applied to a tool string in accordance with the present invention.

FIG. 2 illustrates the present invention and how the forces applied thereto differ from those of the prior art. The tool string collar 20, hereinafter sometimes referred to as a "liquid drill collar", is attached to the nether end of the drill pipe 21. As will be explained in detail below, liquid drill collar 20 has longitudinal annulus 37 therein which is at least partially filled with a dense liquid 22. "Dense liquid" as used herein refers to a liquid whose density is greater than the density of the liquid in wellbore 10. Collar 20 is open to the wellbore at its upper end 25 so that the hydrostatic head of the liquid in wellbore 10 is always applied onto the top of dense liquid 22 in annulus 37 of tool string 20 to combine therewith to produce a downward acting force $F_3$. This force $F_3$ is applied internally to the bottom closure 33 of collar 20 through the column of liquid or liquid continuum within the collar and does not produce through compressive force in the walls of the collars as is the case in the prior art collars 13 of FIGS. 1 and 3 where the weight of the solid collars, themselves, provides the force $F_1$ (FIG. 1) which is functionally equivalent to $F^3$(FIG. 2). In the present invention, only drill bit 14, bottom closure 33, and those lower portions of collar 20 which are joined to closure 33 are in compression until the total downward force exceeds the net force supplied by the dense liquid continuum.

Since the neutral point of bending, $NP_b$, is defined as the imaginary plane perpendicular to the longitudinal axis of the drill string where the sum of the moments acting on the string vanish, this neutral point $NP_b$ (FIG, 2) hypothetically is located well below the nether of the drill string. The difference between the downward force $F_3$ and the bouyant upward force $F_4$ represents the amount of weight that is available to be applied as weight-on-bit for advancing the drill string during drilling without putting any substantial portion in compression. By transmitting the downward force $F_3$ through the liquid continuum within the collar instead of through the walls of the collar, substantially all of the drilling string will remain in tension even when the desired weight is applied to the bit.

Figure 4:
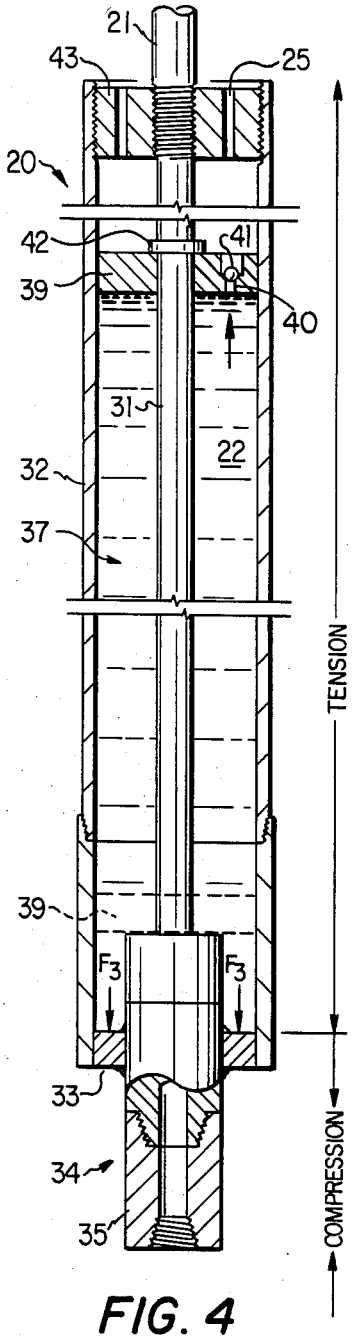
FIG. 4 is an elevational view, partly in section, of a liquid drill collar in accordance with the present inventions.

Turning now to the specific details of liquid drill collar 20, FIG. 4 discloses collar 20 having a body comprised of generally concentric conduits 31, 32 which form an annulus 37 therebetween. The inner conduit 31 is formed of one or more lengths of pipe (e.g. standard drill pipe) which are joined together by threaded connections. Outer conduit 32 is comprised of one or more lengths of a larger diameter tubular also threaded together, as will be explained in more detail below. Heavier lengths of pipe are preferred to makeup the nether end of conduit 32 for added strength. Conduits 31 and 32 are joined together at their nether ends by a thick, heavy sealing closure plate 33 which is welded or otherwise secured thereto. Connector means 34 is secured through an opening in plate 33 by welding or the like and is adapted to be releasably connected at one end of the lower end of inner conduit 31 and at its other end to a tool sub 35.

Slidably mounted on inner conduit 31 is a separator piston or doughnut 39 which initially is in the position shown by dotted lines; its purpose is described later. Piston 39 has a passage 40 therethrough which, in turn, has a check valve 41 therein (e.g. ball valve, flapper valve, etc.) which allow flow only in an upward direction. The upper ends of conduits 31, 32 are joined by plate 43 which is threadedly or otherwise releasably secured thereto. Plate 43 has one or more openings 25 therethrough for fluid communication between annulus 37 and wellbore 10 when collar 20 is in an operable position.

Liquid drill collar 20 as shown in FIG. 4, is for use primarily in straight hole drilling or for drilling deviated wells where they are to be extended only for relatively short distances. In such operations, especially straight hole drilling, outer conduit 32 is comprised of steel or aluminum pipe which can also be used for slight deviated directional wells. Collar 20 is run in and out of wellbore 10 as follows.

A bit 14 (FIG. 2), downhole mud-driven motor 45 (FIG. 6) or other rotary drive tool is attached to sub 35 and lengths of pipe are added to makeup outer conduit 32 as it is lowered into wellbore 10 from the floor of a drilling rig, as will be understood in the art. Drilling mud which fills the wellbore 10 will flow into outer conduit 32 through openings in the bit 14 or through the dump valve of motor 45, as the case may be. The drilling fluid forces piston 39 upward until it engages stop 42 on conduit 31. The pressure of the drilling mud then opens valve 41 so mud will flow upward through passage 40 as the outer conduit is lowered further.

When the desired length of outer conduit 32 is assembled, it is suspended in slips on the rig floor and inner conduit 31 (e.g. standard drill pipe) is madeup and run into outer conduit 32. When the lower end of inner conduit 31 is just above connector means 34, a dense liquid 22 (example below) having a density greater than that of the drilling mud is pumped through inner conduit 31 and into the lower end of conduit 32 to displace all of the drilling mud in annulus 37 below piston 39 upwardly through valve 41 in piston 39.

When a predetermined volume of dense liquid 22 (calculated to provide a desired weight on bit as will be explained below) has been placed in conduit 32 to fill annulus 37 below piston 39, inner conduit 31 is then lowered inside conduit 32 and is releasably connected to connector means 34 which may be any type of releasable connector capable of transmitting substantial torque in either direction. One such means is a connector called a "Safety Joint". distributed by Bowen Tools, Inc., Houston, Texas, and fully described on page 1302 of Composite Catalog of Oil Field Equipment and Services, 1982–83, published by World Oil.

After conduit 31 is connected to connector means 34, upper plate 43 is threaded simultaneously downwardly onto the external surface of inner conduit 31 and the internal surface of outer conduit 32 to couple the two together. Drill string 21, which can be of the same diameter pipe as conduit 31, or it may be larger to increase flow capacity to collar 20 and also to increase return drilling mud velocity for improved cuttings removal, is then madeup and lowered in accordance with routine procedures.

The available weight-on-bit provided by collar 20 is readily calculated as shown by the following example. A collar 20 having a length of 2500 feet is made up of an outer conduit 32 of 10.75-inch outside diameter (OD) and 10-inch inside diameter (ID). The inner conduit 31 is madeup of 5-inch OD drill pipe. The external or lower surface area of bottom plate 33 is 90.72 square inches while the interior or upper surface of plate 33 (i.e. cross sectional area of annulus 37) equals 58.88 square inches. The circulating liquid (drilling mud) in wellbore 10 weighs 10 pounds per gallon (ppg) or has a columnar density of 0.52 psi per foot. The total upward or buoyant force $F_4$ (FIG. 2) acting on bottom plate 33 is $90.72 \times 2500 \times 0.52$ or 117,936 pounds. Remember, the head of the drilling mud above collar 20 is applied to the interior of collar 20 through openings 25 in upper plate 43.

Assuming now that 5000 gallons of dense liquid 42 having a density of 26 ppg, or 1.32 psi per foot, is placed in annulus 37, this volume occupies only 1650 feet of annulus 37 with the remaining 950 feet above piston 39 being filled with the circulating drilling mud. The resulting force $F_3$ on the topside of plate 33 is $[(1650 \times 1.32) + (950 \times 0.52)] \times 58.88$ or 157,327 pounds. the difference between these two forces is 39,391 pounds which is available for weight on bit.

Dense liquids suitable for use in the present invention having a density of 26–27 ppg, while not normally used as a circulating drilling liquid, are known and used as a "kill plug" or "kill pill" to control a blowing well. Many different composition are available, the following being but one example:

0.5 barrels of water
8.0 pounds lignosulfonate
1.0 pounds caustic soda
0.6 pounds zanthun gum polymer
900.0 pounds hematite (finely ground).

If desired, various brine solutions combined with polymers and ladeners also may be used.

In the above example, if the wall area of condiuts 31, 32 is 12 square inches, the net tensile stress of the available 39,391 pound force is 3282 psi. This is well below the tensile strength of commercially available non-metallic tubulars such as fiberglass reinforced plastic conduit, e.g. 27,400 psi strain at failure for K-1250 conduit, distributed by Koch Fiberglass Products Company, Wichita, Kans. Accordingly, non-metallic or reinforced or equivalent plastic conduits may be used at least for conduit 32. It is pointed out that compressive and collapse forces normally are absent in conduit 32.

Another embodiment of the present invention (shown in FIGS. 5–7) is designed for use primarily in wells having a substantial horizontal section. The construction of liquid drill collar **20*a* is basically the same as described before except inner conduit 31 includes one or more valve elements 36 (two shown) incorporated therein and spaced along its length. Valve elements may be of any type which can be opened and closed to selectively communicate the interior of conduit 31 with annulus 37. An example of such a valve element is the Model "L" Sliding Sleeve, distributed by Baker Packers, Houston, Tex., which is a device having an internal sleeve which opens or closes a port 38 by standard wireline methods, see pps. 880–881, Composite Catalog of Oil Field Equipment and Services, 1982–83, published by World Oil. Also, a plurality of pistons 39***a*, 39*b*, 39*c* (three shown) are slidably positioned on inner conduit 31 and initially are in the respective positions shown by dotted lines in FIG. 5.

Collar 20*a* is madeup and run basically the same as described above except that additional liquids are used to fill annulus 37 and the placement therein differs. Outer conduit 32 is assembled and suspended from the rig floor as before. Inner conduit 31 is madeup and lowered to just above connector means 34. A low density liquid (e.g. water or oil) having a density less than the drilling mud is circulated through the lower end of conduit 31 into conduit 32 to force the lowermost piston 39a upward to displace the drilling fluid in annulus 37 thereabove upward from conduit 32 into wellbore 10. Once the desired volume of low density liquid fills annulus 37*a*, conduit 31 is connected to connector means 34 and upper plate 43 is assembled. Valve element 36*a* is then opened and an intermediate density liquid, if different from the drilling liquid, is pumped through port 38 to fill annulus 37*b*. When the desired volume of the intermediate liquid is in place, valve 36*a* is closed and valve 36*b* is opened. If drilling liquid is to be the intermediate liquid, this step is unnecessary since drilling liquid will already fill annulus 37*b*. The most dense liquid is then pumped through drill pipe 21 and port 38 in valve 36*b* to fill annulus 37*c*, after which valve 36*b* is closed.

Figures 6, 7:
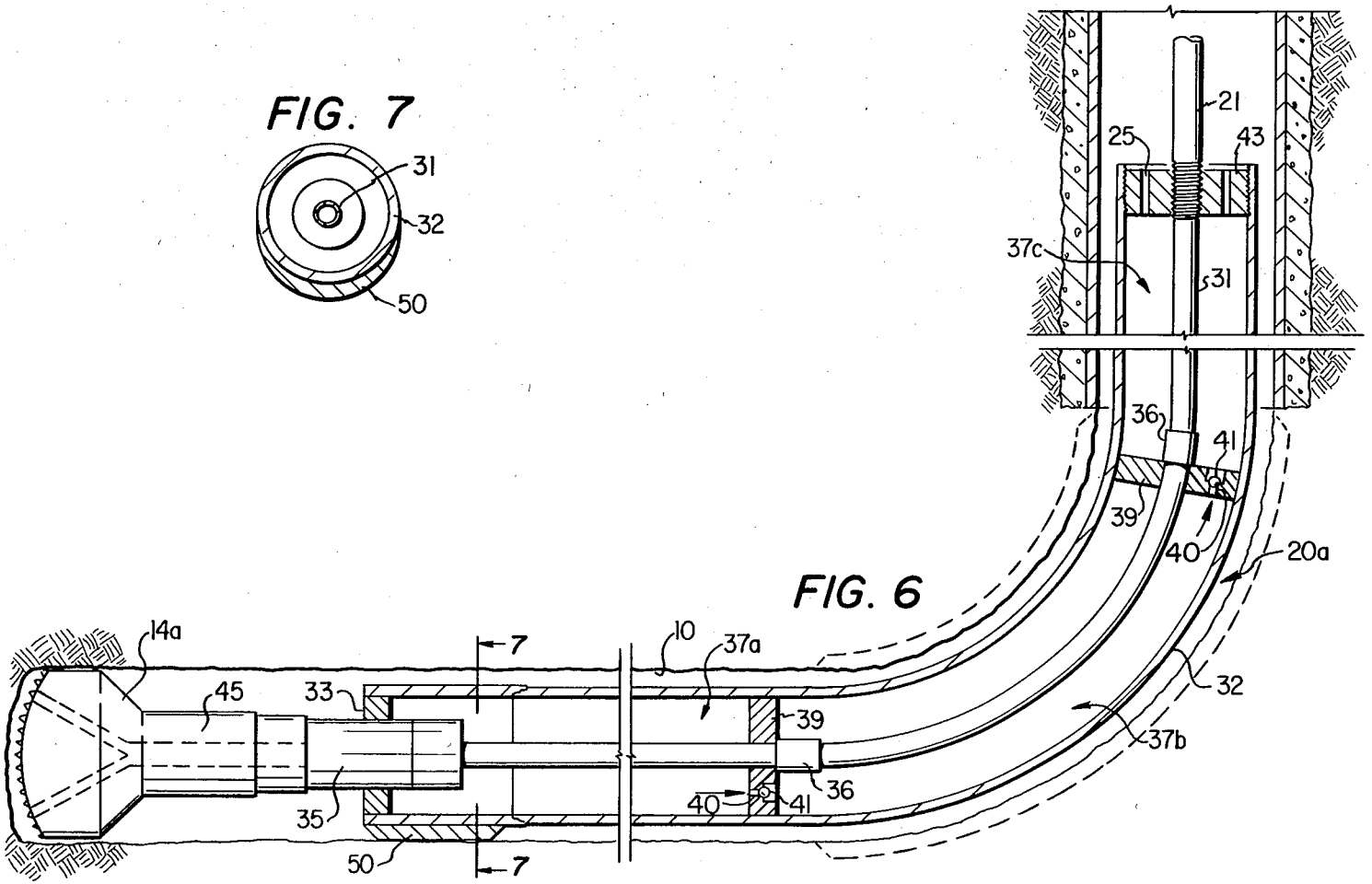
FIG. 6 is an elevational view, partly in section, of the collar of FIG. 5 as it is used in the drilling of a horizontal wellbore.
FIG. 7 is a sectional view taken along line 7—7 of FIG. 6.

As shown in FIG. 6, liquid drill collar 20*a* carries a downhole mud-driven motor 45 which rotates bit 14*a*. Annulus 37*a* is filled with a low density liquid to provide a buoyancy force in the more dense drilling liquid in the horizontal portion of wellbore 10, preferably making collar 20*a* essentially neutrally buoyant therein. This aids in keeping the drill string off the bottom of the horizontal portion thereby reducing frictional drag due to gravity, and hence, resistance to the advance of the drill string. Intermediate densityliquid, e.g. same density as the drilling liquid, fills annulus 37*b* which is designed to lie in the curved portion of wellbore 10 during operations. Intermediate liquid is used when additional buoyancy is undesirable. That is, it may not be desirable to fill too great a length of the annulus with low density liquid thereby providing too much buoyancy. Likewise it may be undesirable to fill too great a length with dense liquid thereby providing too much weigh so an intermediate density liquid is used to provide the proper sequence of liquids and a continuous liquid column or continuum throughout annulus 37.

As seen in FIG. 6 the dense liquid in annulus 37*c* will be substantially vertical in the vertical portion of the wellbore during drilling so that the total head of the dense liquid is applied downwardly through the liquid column in annulus 37 onto the interior of closure plate 33 to act as an advancing force even though the lower section of collar 20 is curved 90 degrees. It is understood that additional lengths of pipe can be added to conduits 31, 32 during a trip and the volumes of the different liquids adjusted to maintain a proper placement of liquids in the respective portions of the wellbore as wellbore 20 is extended.

Also, as shown in FIG. 6, an eccentric spacer 50 is mounted about a portion of the outer periphery of the nether end of outer conduit 32 so as to normally rest upon the lower wall of the horizontal portion of wellbore 10 during drilling to support and center motor 34 therein. As will be understood, if the entire drill string is rotated from the surface, spacer 50 will be accordingly rotated to direct the drilling either to the right or left as the case may be. Further, for directional control during the drilling of a horizontal well, a standard drill collar (not shown), can be connected between sub 35 and motor 45 and stabilizers can be attached thereto or to motor 45 as will be understood in the art.

Figure 5:
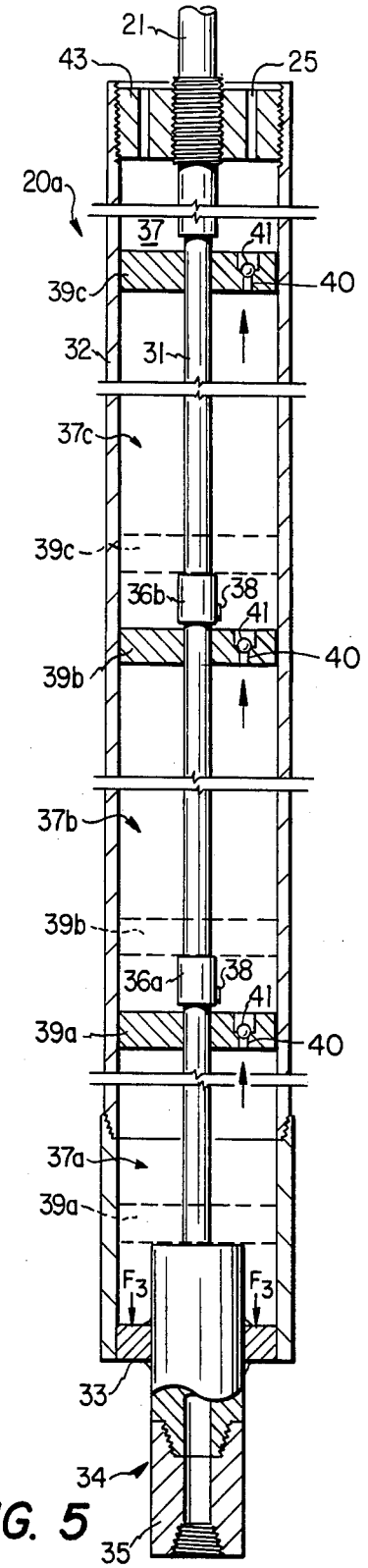
FIG. 5 is an elevational view, partly in section of a further embodiment of the collar of FIG. 4.

In retrieving collar 20 at the surface, the upper end of outer conduit 32 is held by slips on the rig floor and upper plate 43 is disconnected. Inner conduit 31 is disconnected from connector means 34 and is raised slightly so that the expensive dense liquid 22 (FIG. 4) can be pumped out and saved. In the embodiment of FIG. 5, valve 36*b* would be opened to remove the dense liquid in annulus 37*c*. After the dense liquid is recovered, conduit 31 is broken out and pulled and stacked by routine procedures, after which these steps are repeated to remove outer conduit 32. This technical operation requires the handling of only one string of conduit at a time.

While liquid drill collar 20 has been described primarily in relation to drilling operations, it should be recognized that it also could be used for applying weight to the nether end of other tool strings, e.g. casing strings, logging strings, etc. to advance said strings into wellbores, especially into the horizontal portion beyond a curved wellbore. In each instance, sufficient weight is applied without even putting any substantial portion of the tool string in compression thereby allowing substantially the entire string to remain in tension. This greatly alleviates the buckling, binding, or drag normally experienced by previous known tool strings.

What is claimed is:

1. A collar adapted to be connected to the nether end of a tool string which, in turn , is to be used in a wellbore filled with a wellbore liquid; said collar comprising:

a body having a long longitudinal annulus extending throughout thereof and being closed at its lower end;

a dense liquid filling at least a portion of said annulus, said dense liquid having a density greater than that of said wellbore liquid; the head of said dense liquid adapted to apply a force onto said lower end closure of said annulus when said collar is in an operable position in a wellbore; and means for fluid communication between the upper end of said annulus above said dense liquid and said wellbore fluid when said collar is in an operable postion within said wellbore.

2. The collar of claim 1 including:

a mobile means in said annulus positioned to separate said dense liquid from said wellbore liquid in said annulus.

3. The collar of claim 1 including:

a sub affixed to the nether end of said collar adapted to be connected to a well tool.

4. The collar of claim 1 including:

a low density liquid filling at least a portion of said annulus and positioned below said dense liquid when said collar is in an operable position in said wellbore, said low density liquid having a density less than that of said wellbore liquid.

5. The collar of claim 4 including:

a means slidably mounted in said annulus and positioned to separate said low density liquid from said dense liquid in said annulus.

6. The collar of claim 1 wherein the density of said dense liquid is at least 24 pounds per gallon.

7. A collar adapted to be connected to the nether end of a tool string which is to be used in a wellbore filled with a wellbore liquid, said collar comprising:

a body comprising:

an outer conduit;

an inner conduit adapted to be connected to said tool string mounted within said outer conduit and forming an annulus therebetween;

a closure means for connecting the nether ends of said conduits together;

a dense liquid at least partially filling said annulus, said dense liquid having a density greater than that of said wellbore liquid, the head of said dense liquid adapted to apply a force onto the upper surface of said nether end closure means when said collar is in an operable position in said wellbore; and an upper means for connecting the upper ends of said conduits, said upper means having passage means therethrough for fluid communication between the upper end of said annulus above said dense liquid and said wellbore liquid when said collar is in an operable position in said wellbore.

8. The collar of claim 7 including:

a liquid separation means positioned between said dense liquid and said wellbore fluid in said annulus.

9. The collar of claim 8 including:

a low density liquid filling at least a portion of said annulus and positioned below said dense liquid when said collar is in an operable postion in said wellbore, said low density liquid having a density less than that of said wellbore liquid.

10. The collar of claim 9 including:

a second liquid separation means positioned between said low density liquid and said dense liquid.

11. The collar of claim 10 including:

an intermediate density liquid filling at least a portion of said annulus and positioned between said low density liquid and said dense liquid.

12. The collar of claim 7 wherein at least said outer conduit is comprised of at least one length of steel pipe.

13. The collar of claim 7 wherein at least said outer conduit is comprised of at least one length of aluminum pipe.

14. The collar of claim 7 wherein at least said outer conduit is comprised of at least one length of non-metallic pipe.

15. The collar of claim 7 wherein at least said outer conduit is comprised of at least one length of plastic pipe.

16. The collar of claim 7 wherein said closure means comprises:

a plate affixed to said nether end of said outer conduit, a connector means affixed to said plate and extending therethrough, said connector means adapted to be releasably connected to said nether end of said inner conduit.

17. The collar of claim 16 wherein said upper connecting means comprises:

a plate releasably connecting said upper ends of said conduits.

18. The collar of claim 17 including:

a sub connected to the nether end of said connector means, said sub being adapted to be connected to a well tool.

19. The collar of claim 7 including:

at least one valve element in said inner conduit for fluid communication between the interior of said inner conduit and said annulus.

20. The collar of claim 7 including:

a spacer mounted about a portion of the outer periphery of the nether end of said outer conduit whereby said nether end of said conduit is arranged spatially in relation to said wellbore.

21. The collar of claim 7 wherein the density of said dense liquid is at least 24 pounds per gallon.

22. A fluid continuum means for transmitting a useful portion of the weight of a dense liquid from a substantially vertical wellbore to a substantially horizontal section of said wellbore, said wellbore being filled with a wellbore liquid, said means comprising:

a conduit, said conduit having a closure at the bottom thereof and in fluid communication with said wellbore liquid at the top thereof;

a volume of dense liquid inside said conduit, said dense liquid having a density greater than said wellbore liquid;

a volume of low density liquid in said conduit below said dense liquid, said low density liquid having a density less than said wellbore liquid;

a means in said conduit separating said dense liquid and said low density liquid;

a tool means affixed to said closure; and a means for advancing said conduit into said wellbore whereby at least a portion of the weight of said dense liquid acts through said liquid continuum to advance said tool means in said horizontal wellbore section.

23. The fluid continuum means of claim 22 wherein said means for advancing said conduit comprises:

a tubular tool string attached to said conduit and extending to the surface of said wellbore.

24. A method of applying force from the nether end of a tool string to advance said tool string in a wellbore filled with a wellbore liquid while maintaining substantially the entire tubular tool string in tension, said method comprising:

providing a collar on said nether end of said tool string, said collar having an annulus extending longitudinally therethrough which is closed at the bottom and open to said wellbore liquid at the top end thereof;

filling at least a portion of said annulus with a volume of dense liquid having a density greater than the density of said wellbore liquid, said volume providing a sufficient head of dense liquid in said annulus which when combined with the head of said wellbore liquid acting thereon will exert a downward force on the closed end of said annulus substantially greater than the buoyant force of said wellbore liquid acting upwardly on said tool string.

25. The method of claim 24 wherein said density of said dense fluid is greater than 24 pounds per gallon.

26. The method of claim 24 wherein said wellbore has a vertical section and a horizontal section extending therefrom, said method including:

filling at least a portion of said annulus below said dense liquid with a low density liquid having a density less than that of said wellbore liquid whereby said portion of said annulus containing said low density liquid will be in said horizontal section of said wellbore and said portion of said annulus containing said dense liquid will be in said vertical section of said wellbore when said tool string is in an operable position in said wellbore.

* * * * *